US006367105B1

(12) United States Patent
Farley

(10) Patent No.: US 6,367,105 B1
(45) Date of Patent: Apr. 9, 2002

(54) SUPPORTING DEVICE WITH A CASING ADJUSTABLY RETAINING PILLOWS HAVING MALLEABLE CORES

(76) Inventor: Linda F. Farley, 1926 Cornell, Springfield, IL (US) 62703

( * ) Notice: Subject to any disclaimer, the term of this patent is extended or adjusted under 35 U.S.C. 154(b) by 0 days.

(21) Appl. No.: 09/990,313

(22) Filed: Nov. 23, 2001

(51) Int. Cl.[7] ..... A47G 9/00
(52) U.S. Cl. ..... 5/630; 5/636; 5/640; 5/490
(58) Field of Search ..... 5/630, 632, 636, 5/637, 640, 643, 646, 648, 490, 652, 657; D6/601

(56) References Cited

U.S. PATENT DOCUMENTS

| | | | | | |
|---|---|---|---|---|---|
| 4,091,481 | A | | 5/1978 | Redman | |
| D256,414 | S | | 8/1980 | Rick | |
| 4,382,306 | A | * | 5/1983 | Lickert | 5/992 |
| 4,756,035 | A | * | 7/1988 | Beier | 5/643 |
| 4,768,248 | A | * | 9/1988 | O'Sullivan | 5/640 |
| 4,959,879 | A | | 10/1990 | Marxhansen | |
| 4,959,880 | A | * | 10/1990 | Tescm | 5/490 |
| 5,157,799 | A | * | 10/1992 | Aird | 5/490 |
| 5,261,134 | A | | 11/1993 | Matthews | |
| 5,596,780 | A | * | 1/1997 | Brenn | 5/636 |
| D390,407 | S | | 2/1998 | Spinks | |
| D397,902 | S | * | 9/1998 | Knorrek | D6/601 |
| 5,953,777 | A | * | 9/1999 | Buck | 5/636 |
| 6,151,733 | A | * | 11/2000 | Takashima | 5/640 |
| 2001/0003219 | A1 | * | 6/2001 | Chou | 5/636 |

FOREIGN PATENT DOCUMENTS

| | | | | |
|---|---|---|---|---|
| DE | 4237792 A1 | * | 9/1992 | 5/655 |

* cited by examiner

*Primary Examiner*—Alexander Grosz
(74) *Attorney, Agent, or Firm*—Patent & Trademark Services; Joseph H. McGlynn

(57) ABSTRACT

A device to comfortably support the body regions and body limbs of physically disabled children or adults. The device consists of a plurality of aesthetically shaped malleable pillows and a pillow case. The malleable pillows have a firm and pliable inner core and an outer layer that is soft and resilient, which makes the malleable pillow easy to mold to conform to a person's body.

4 Claims, 3 Drawing Sheets

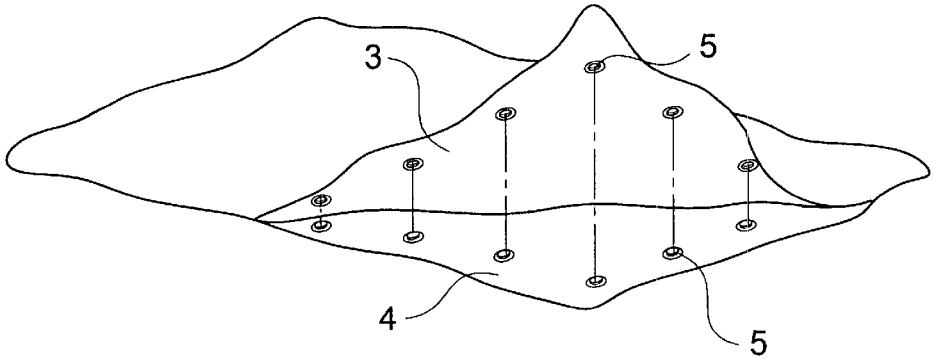
FIG.6
FIG.7
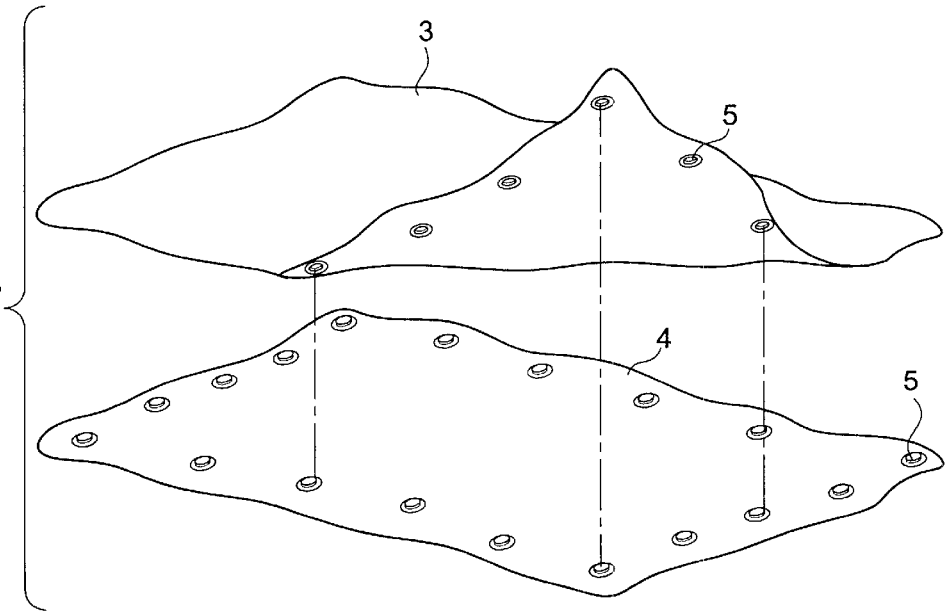

SUPPORTING DEVICE WITH A CASING ADJUSTABLY RETAINING PILLOWS HAVING MALLEABLE CORES

BACKGROUND OF THE INVENTION

This invention relates, in general, to a pillow and a pillow case, and in particular to a pillow and pillow case for use in positioning and in supporting body regions and the body limbs of a physically disabled child or adult.

Description of the Prior Art

In the prior art various types of pillows have been proposed. For example, U.S. Pat. No. 5,261,134 to Matthews discloses a portable pillow to support an infant, toddler, or small child.

U.S. Pat. No. 4,959,879 to Marxhausen discloses a method for disguising a pillow with a fancy sheath and attachments for displaying within a living area.

U.S. Pat. No. 4,091,481 to Redman discloses a child's pillow shaped in a three dimensional tooth with an outside pocket for receiving a tooth or a coin.

U.S. Pat. No. Des 390,404 to Spinks discloses an ornamental design for a child's pillow.

U.S. Pat. No. Des 256,414 to Rich discloses an ornamental design for a stuffed animal figure and pillow.

SUMMARY OF THE INVENTION

The present invention is directed toward a device for use in supporting body regions and the body limbs of a physical disabled child or adult, which comprises a plurality of malleable pillows and a pillow case. The malleable pillows have the shape of aesthetically appealing objects in any motif, such as celestial objects, animals, fruits, and hearts. The malleable pillows have an outer layer made of a soft, yet resilient material. The malleable pillows have an inner core made of a firm, malleable material for shaping the pillow to fit the contour of the body region or body limbs that are to be supported. The malleable pillows have a removable, washable protective covering which is coordinated in shape and color to the aesthetic motif of the malleable pillows. The malleable pillows may be used singly or a plurality of the pillows can be inserted inside the pillow case.

The pillow case is made from essentially two pieces of fabric. The perimeter edge of each piece of fabric is equipped with an attachment means, for joining the two pieces of fabric into the shape of a pillow case. At any portion of the perimeter wall of the pillow case, the two joining pieces of fabric may be detached from each other, such that any number of malleable pillows may be inserted into the pillow case or removed from the pillow case, after which, the opening in the perimeter wall of the pillow case may be closed by the attachment means. When the pillow case is not in use as a pillow case, the two pieces of fabric may be completely separated along the perimeter edges by the attachment means and used for a blanket or covering. The pillow case may be used as a carrying case for a plurality of malleable pillows. The pillow case is made of a fabric that is easily washed. The removable outer sheath cover of the malleable pillows is made of a fabric that is also easily washed.

The pillow case and attachment means enables easy access to the care giver when the device is being used. The care giver can access the malleable pillows inside the pillow case when in use, from any direction along the perimeter of the pillow case. This can be done by detaching an area of the attachment means that joins the two pieces of fabric together and then repositioning, reshaping, adding to or removing pillows from the pillow case. This eliminates any major physical disruption to the physically disabled child or adult. Additionally, the pillow case may be completely disassembled and removed from the pillows with minimal physical disruption to the disabled child or adult.

The aesthetically shaped malleable pillows and the pillow case may be constructed in different sizes for use in supporting the body region and body limbs of children and adults.

It is an object of the present invention to provide a new and improved pillow and pillow case for use in supporting the body region and body limbs of a child or adult with physical disabilities.

It is another object of the present invention to provide a new pillow with a soft and resilient outer layer and a firm and pliable inner core, enabling the pillow to be shaped to the contour of the body region and body limbs to comfortably support the body region and body limbs.

It is another object of the invention to provide a pillow case that can be easily assembled and disassembled from two pieces of fabric, and means for accessing the malleable pillows from any place along the perimeter of the pillow case while the device is being used.

It is another object of the present invention to provide a pillow case that may serve as a carrying case for a plurality of the malleable pillows, or a blanket or covering when the device is not in use.

It is an object of the present invention to provide a device to support the body regions and body limbs of a child or adult with physical disabilities, which can be easily adjusted from any direction along its perimeter, thereby limiting the amount of physical disruption caused to the user and limiting the amount of physical exertion required of the care giver.

These and other objects and advantages of the present invention will be fully apparent from the following description when taken in connection with the annexed drawings.

BRIEF DESCRIPTION OF THE DRAWINGS

FIG. 6 is a view of the empty pillow case.

FIG. 7 is a view of each of the pillow case with the two pieces of fabric completely detached from each other.

DESCRIPTION OF THE PREFERRED EMBODIMENTS

Figure 1:
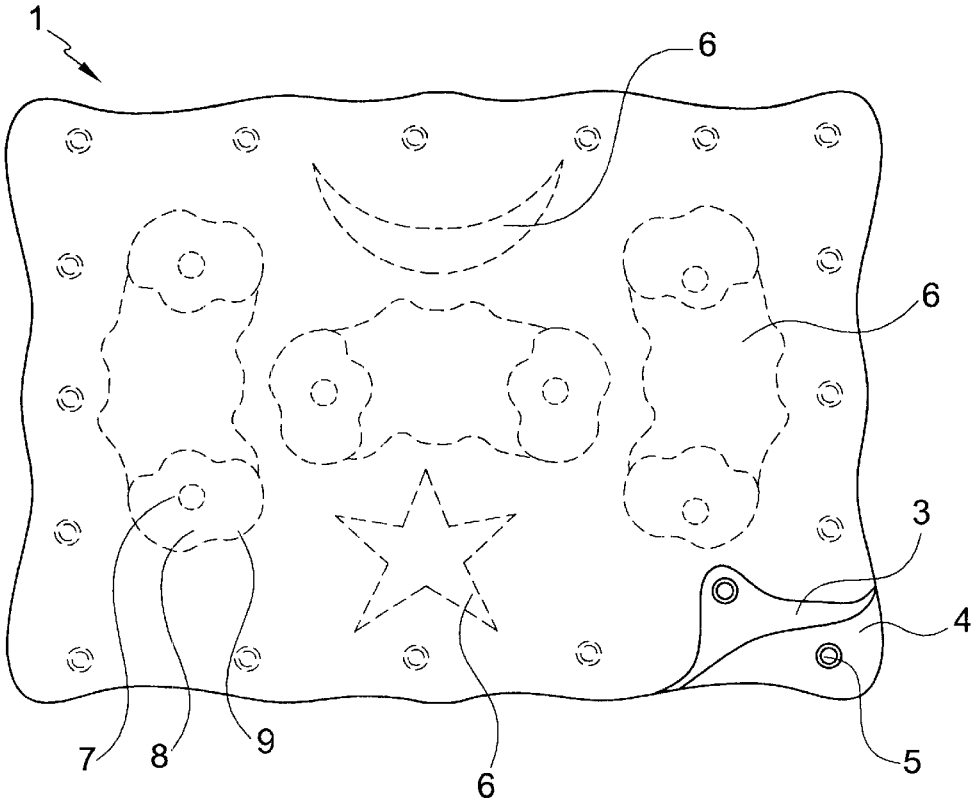
FIG. 1 is a view of the pillow case with one corner of the pillow case detached.

Referring now to the drawings in greater detail, FIG. 1 shows a pillow case 1, and a plurality of pillows 6 inside the pillow case 1. It should be noted that the pillows 6 are shown in different shapes to allow the user versatility in supporting various parts of the body of the handicapped person. For example, a long pillow could be used to support a person's back, while smaller pillows could be used to support a person's arms, wrist, etc. The pillow case 1 is assembled by joining two layers of fabric 3 and 4 along one side and attaching them together with a plurality of attachment means 5 that are positioned around the other three sides of the fabric 3, 4. The pillow case is designed for use with a plurality of pillows 6, however, the number of pillows used will vary depending on the size of the person they will support or the part of the body they will support.

FIG. 1 displays the accessibility of the pillows 6 which are located inside the pillow case 1 via the attachment means 5 when the device is in use. When used in conjunction with the pillow case 1, as a supporting device, the malleable pillows 6 may be accessed from any direction around the perimeter of the pillow case 1. The attachment means 5 can be detached and reattached quickly and easily for adding more pillows 6, or for reshaping and repositioning the pillows 6.

Figure 2:
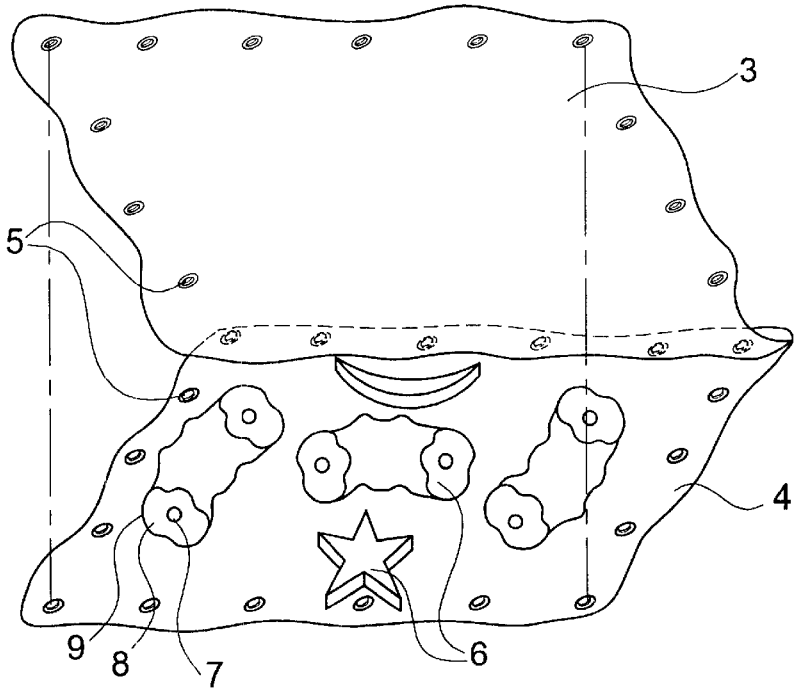
FIG. 2 is a view of the pillow case in the fully open position.

The malleable pillows 6 may be used independently of the pillow case 1 to support any part of the body region and body limbs. The malleable pillows 6 are shaped in different styles and sizes for use as a supporting device to support different parts of the body. As seen in FIG. 2, a plurality of elongated pillows are removably and adjustably inserted in the casing.

Figure 3:
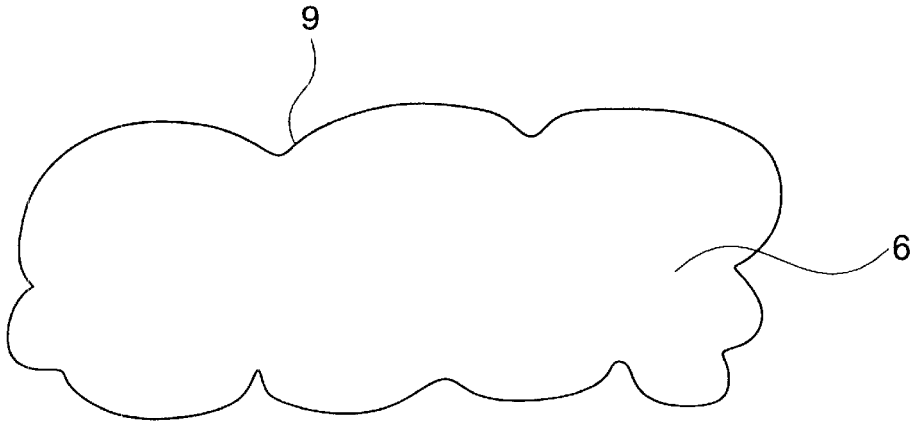
FIG. 3 is a side view of one of the pillows.
Figure 4:
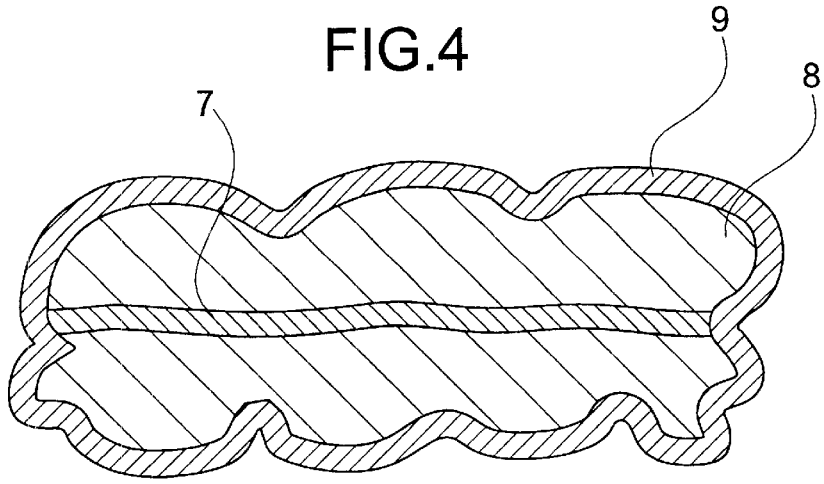
FIG. 4 is a horizontal cross sectional view of one of the pillows.
Figure 5:
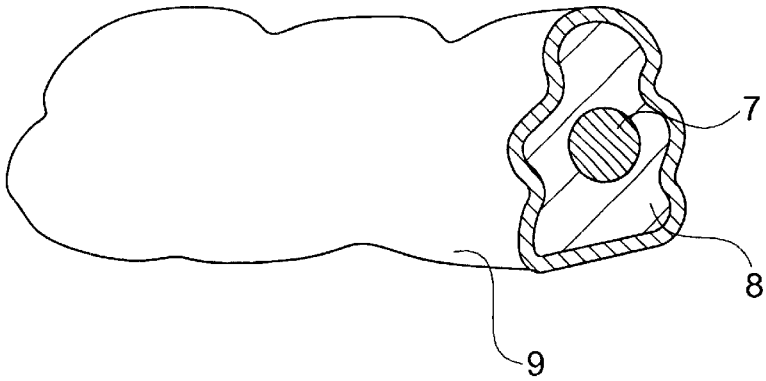
FIG. 5 is a perspective view of one of the pillows with a portion of the end removed.

FIGS. 3, 4 and 5 show the soft, resilient and malleable features of the pillows 6. The pillows 6 are composed of a soft and resilient outer layer 8, which surrounds an inner core 7. The inner core 7 is composed of a firm and malleable material, enabling them to be molded to the contour of a body region or limb, and to retain that shape. The pillows 6 have a removable, washable cover 9, which can be easily removed for washing.

FIG. 2 shows the pillow case 1 in an open position with side 3 of the pillow case detached from side 4 at three sides of the two pieces of fabric. The pillows 6 may be arranged in the pillow case 1, by the care giver, prior to supporting the body region or body limbs of the physically disabled child or adult.

Each malleable pillow 6 can be formed to the body region or limb to be supported. After the arrangement of the malleable pillows 6 is completed, the pillow case 1 is closed by bringing side 3 and 4 together and securing them with the attachment means 5.

The device 1 is used as a support for any region of the body of the physically disabled child or adult, such as for supporting the superior, dorsal, and caudial body regions while the child or adult is in a seated or in a prone body position.

The pillows may be molded to certain regions of the individual's body, such as the head, neck, upper or lower limbs, and used with or without the pillow case.

The ability to mold the malleable pillow 6 to fit the contour of a body region or body limb is enabled by the inner core 7, which is made of a firm, yet pliable, material. The support and comfort feature of the malleable pillow 6 is provided by the soft, yet resilient, outer layer 8 of the malleable pillow 6.

The aesthetic quality of the malleable pillows 6 is in the nature of the theme, shape, and color of the pillows and the child or adult can select his or her favorite theme.

Another feature of the supporting device 1, is that it eliminates the overall physical disruption to the user, when the malleable pillows 6 need to be adjusted inside of the pillow case 1. Similarly, less physical exertion to the care giver is required to rearrange the malleable pillows 6.

FIGS. 6 and 7 show another feature of the supporting device 1. When the malleable pillows 6 are used independently, without the pillow case 1, the pillow case 1 may be disassembled to serve as a blanket or covering.

Although the body supporting device and method of using the same has been described in the foregoing specification in detail, it is to be understood that modifications may be made to the invention which do not exceed the scope of the claims and modified forms of the present invention done by others skilled in the art to which the invention pertains will be considered infringements of this invention when those modification forms fall within the scope of this invention.

What I claim as my invention is:

1. A supporting device for use in supporting body regions of persons with physical disabilities, said device comprising:

a casing, said casing having two parts, each part having an outer and an inner surface and edges, attachment means for attaching said two parts together, a plurality of elongated pillows, removably and adjustably inserted between said inner surfaces of said casing, said pillows comprised of a malleable inner core, a soft covering around said inner core, and an outer layer covering said soft covering.

2. The supporting device as claimed in claim 1, wherein said two parts are permanently joined together along one of said edges, and said two parts are detachably joined together along all other edges.

3. The supporting device as claimed in claim 1, wherein said outer layer is removable.

4. The supporting device as claimed in claim 1, further comprising additional pillows of various shapes.

* * * * *